US011391031B2

(12) United States Patent
Lappalainen

(10) Patent No.: US 11,391,031 B2
(45) Date of Patent: Jul. 19, 2022

(54) METHOD OF CONTROLLING A VACUUM WASTE SYSTEM AND A VACUUM WASTE SYSTEM

(71) Applicant: EVAC OY, Espoo (FI)
(72) Inventor: Vesa Lappalainen, Vantaa (FI)
(73) Assignee: EVAC OY, Espoo (FI)

( * ) Notice: Subject to any disclaimer, the term of this patent is extended or adjusted under 35 U.S.C. 154(b) by 100 days.

(21) Appl. No.: 16/093,784
(22) PCT Filed: Mar. 23, 2017
(86) PCT No.: PCT/FI2017/050205
§ 371 (c)(1),
(2) Date: Oct. 15, 2018
(87) PCT Pub. No.: WO2017/182698
PCT Pub. Date: Oct. 26, 2017

(65) Prior Publication Data

US 2019/0203456 A1 Jul. 4, 2019

(30) Foreign Application Priority Data

Apr. 19, 2016 (FI) ..... 20165343

(51) Int. Cl.
*E03F 1/00* (2006.01)

(52) U.S. Cl.
CPC ..... *E03F 1/007* (2013.01); *E03F 1/00* (2013.01)

(58) Field of Classification Search
CPC ..... E03F 1/007; E03F 1/00; E03F 1/006
See application file for complete search history.

(56) References Cited

U.S. PATENT DOCUMENTS

RE28,189 E * 10/1974 Linjendahl ..... E03F 1/007 4/300
5,495,626 A * 3/1996 Lindroos ..... E03F 1/006 4/435

(Continued)

FOREIGN PATENT DOCUMENTS

CN 101349072 A * 1/2009
JP H0610403 B2 * 2/1994 ..... F01D 17/165

(Continued)

OTHER PUBLICATIONS

Search Report for related Finland Application No. 20165343; report dated Nov. 30, 2016.

(Continued)

*Primary Examiner* — Angelisa L. Hicks
(74) *Attorney, Agent, or Firm* — von Briesen & Roper, s.c.

(57) ABSTRACT

Method of controlling a vacuum waste system, which comprises a number of sources of waste (9), vacuum sewer piping (7) including at least a branch pipe (71) and at least a main pipe line (72), a discharge valve (8) having an inlet end connected to a source of waste and an outlet end provided with a given type of connection to the vacuum sewer piping, and a vacuum unit (11) connected to the vacuum sewer piping. Vacuum is generated in the vacuum sewer piping by the vacuum unit and a discharge sequence for discharging waste from the source of waste into the vacuum sewer piping is activated by a discharge sequence activating means (20), whereby the discharge sequence is set for a predetermined time. In order to achieve an optimized control of the vacuum waste system, the predetermined time for a discharge sequence for a source of waste is set according to the given type of connection (711, 712) of the discharge valve to the vacuum sewer piping or according to the location (L1, L2) of the discharge valve with respect to the vacuum sewer piping.

21 Claims, 5 Drawing Sheets

(56) References Cited

U.S. PATENT DOCUMENTS

| | | | | | |
|---|---|---|---|---|---|
| 5,575,304 | A * | 11/1996 | Hassett | E03F 1/007 | 137/1 |
| 5,732,417 | A * | 3/1998 | Pondelick | E03F 1/006 | 4/427 |
| 6,131,596 | A * | 10/2000 | Monson | E03F 1/007 | 137/14 |
| 8,028,715 | B2 * | 10/2011 | Shimizu | E03F 1/006 | 137/465 |
| 8,468,616 | B2 * | 6/2013 | Song | E03F 1/006 | 4/431 |
| 2007/0175515 | A1 * | 8/2007 | Lindroos | E03F 1/006 | 137/205 |

FOREIGN PATENT DOCUMENTS

| | | | |
|---|---|---|---|
| JP | H073857 | A | 1/1995 |
| JP | H08277555 | A | 10/1996 |
| JP | 2007270612 | A | 10/2007 |
| JP | 2008528827 | A | 7/2008 |
| RU | 2491392 | C2 | 8/2013 |
| WO | 0190495 | A1 | 11/2001 |
| WO | 03000999 | A1 | 1/2003 |

OTHER PUBLICATIONS

Search Report for related International Application No. PCT/FI2017/050205; report dated Jul. 10, 2017.
Japanese Office Action for related Application No. 2018-554774; dated Jan. 5, 2021.

* cited by examiner

METHOD OF CONTROLLING A VACUUM WASTE SYSTEM AND A VACUUM WASTE SYSTEM

TECHNICAL FIELD

The present invention relates to a method of controlling a vacuum waste system, which comprises a number of sources of waste, vacuum sewer piping including at least a branch pipe and at least a main pipe line, a discharge valve having an inlet end connected to a source of waste and an outlet end provided with a given type of connection to the vacuum sewer piping, a vacuum unit connected to the vacuum sewer piping, in which method vacuum is generated in the vacuum sewer piping by the vacuum unit, a discharge sequence for discharging waste from the source of waste into the vacuum sewer piping is activated by a discharge sequence activating means, and in which method the discharge sequence is set for a predetermined time, which discharge sequence includes an opening and closing of the discharge valve for discharging waste from the source of waste into the vacuum sewer piping, according to claim 1. The present invention also relates to a vacuum waste system according to the preamble of claim 19.

BACKGROUND ART

Vacuum waste systems are well known and may also be referred to as e.g. vacuum drainage systems, vacuum sewage systems or vacuum toilet systems depending on the main type of waste. The main types of waste treated in vacuum waste systems in this context generally comprise black water (toilets, urinals), grey water (showers, wash basins), or food waste (food waste stations, galleys, kitchens).

Vacuum waste systems are disclosed e.g. in EP 0 333 045 B1, EP 1 172 492 B1, WO 2006/079688 A1, EP 1 840 282 B1 and WO 2008/074915 A1. RU 2 491 392 C2 discloses a compact vacuum toilet unit. JP H0610403 A discloses a combined gravity sewer system and vacuum sewer system for buildings. The sources of waste in a building are discharged in a traditional way by gravity into an outside collection tank, from where waste is further transported by means of vacuum through a vacuum station. The operation of the discharge valve is controlled by a complex combination of metering accumulated waste in the collection tank, air and waste flow rates, available vacuum and power consumption. Further, WO 2017/182698 A1 discloses a vacuum drainage system particularly for small installations with one or a small number of toilets, urinals, sinks, etc. The discharge function is controlled based on the vacuum level in a very short vacuum hose, which connects a toilet with a vacuum pump.

In general the known vacuum waste systems the discharge valves between the source of waste and the vacuum sewer piping have a discharge sequence set for a predetermined and fixed time throughout the whole vacuum waste system independently e.g. of the location, i.e. the distance of the respective source of waste from the vacuum unit, or the type of connection, upwards connection or downwards connection, between the discharge valve and the vacuum sewer piping.

In addition, the predetermined and fixed time is normally set for an upwards connection to vacuum sewer piping having a predetermined vertical height in order to ensure an appropriate discharge in such a set-up. In a large size vacuum waste system including a large number of sources of waste, the vacuum level available in the vacuum sewer piping at a source of waste at locations far away from the vacuum unit is in general lower than the vacuum level available at locations closer to the vacuum unit. In a small size vacuum waste system, with a small number of sources of waste, the vacuum levels available at the sources of waste do not differ so much, whereby the location of the source of waste is not an as critical issue in this respect.

A higher transport resistance for the discharged waste, i.e. an upwards connection, as compared to a lower transport resistance for the discharged waste, i.e. a downwards connection, requires a longer discharge sequence. In a corresponding manner, a lower available vacuum level requires a longer discharge sequence than a higher available vacuum level, whereby the vacuum level is dependent on the location, i.e. in practice the distance of the source of sewage from the vacuum unit.

In a conventional vacuum waste system the predetermined and fixed time of the discharge sequence is set in order to ensure a complete discharge of waste at a point farthest away from the vacuum unit and with an upwards connection to the vacuum sewer piping. This means that the set predetermined time has to be long enough to take into account the lower vacuum level and the transport resistance. The set predetermined and fixed time is consequently also the same for a discharge sequence for a source of waste e.g. closer to the vacuum unit and e.g. with a downwards connection, although a shorter time would be sufficient.

Thus, in both situations, an equally large amount of air is sucked into the vacuum piping. The amount of atmospheric air sucked into the vacuum sewer piping increases in relation to the time for a discharge sequence. When atmospheric air is sucked into the vacuum sewer piping, the vacuum level is lowered. Thus, the vacuum level decreases corresponding to the amount of atmospheric air sucked into the vacuum sewer piping. As a result, the running time of the vacuum unit, in order to (re)generate and maintain a necessary vacuum level in the vacuum sewer piping, will be longer than actually necessary taking account the various locations and connections of the sources of waste. For instance, with a downwards connection and a location closer to the vacuum unit, a shorter discharge sequence would be sufficient to effect a complete discharge of waste into the vacuum sewer piping.

This also increases the start-up frequency of the vacuum unit, since the vacuum level will more frequently drop to or below a given lower vacuum level necessary for an appropriate operation of the vacuum waste system. In other words, more vacuum is generated in the vacuum waste system than would be necessary, which raises the energy consumption and the operating costs of the system.

In vacuum waste systems including a flush water valve, normally connected to a source of flush water, also the flushing sequence, i.e. the supply of flush water in connection with the discharge sequence, is set for a predetermined and fixed time. Consequently, the amount of flush water consumed for each flushing sequence in connection with each discharge sequence is the same although an effective flushing could be carried out with less flush water, if the amount or type of waste would be considered.

SUMMARY OF THE INVENTION

An object of the present invention is to avoid the above mentioned drawbacks and to achieve an efficient, simple and cost effective control of the vacuum waste system. This object is attained by the method according to claim 1.

The basic idea of the invention is to set the predetermined time for a discharge sequence so that said time is sufficient for carrying out the discharge sequence at a given source of waste in an appropriate manner, but not longer than required resulting in an unnecessary consumption of vacuum.

This is realized in that the predetermined time for a discharge sequence for a source of waste is set according to the given type of connection of the discharge valve to the vacuum sewer piping. The type of connection of the discharge valve to the vacuum sewer piping indicates the type of pipe configuration between the discharge valve and the vacuum sewer piping. The transport resistance of the waste is dependent on the pipe configuration.

The given type of connection of the discharge valve to the vacuum sewer piping is identified as a downwards connection, i.e. a downward pipe configuration, which results in a lower transport resistance for discharging waste requiring a shorter predetermined time, or an upwards connection, i.e. an upward pipe configuration, which results is a higher transport resistance for discharging waste requiring a longer predetermined time. This allows for setting or adjusting the predetermined time of the discharge sequence in view of the transport resistance of the waste in connection with the discharge sequence.

The predetermined time for a discharge sequence may also be set according to the location of the discharge valve, i.e. the distance between the discharge valve and the vacuum unit. The vacuum level in the vacuum piping is dependent on distance of the discharge valve from the vacuum unit.

The advantage of this solution is that the transport resistance of the waste as it is discharged into the vacuum sewer or the vacuum level at the discharge point of the waste is taken into account in setting the predetermined time for the discharge sequence.

The vacuum level in a vacuum sewer piping is usually lower at a point farther away, i.e. at a longer distance from the vacuum unit than at a point closer, i.e. at a shorter distance from the vacuum unit. Thus, in this way, also the difference in the vacuum level is taken into account in setting the predetermined time for the discharge sequence.

In this manner the consumed vacuum is limited to a necessary amount. Consequently, the consumption of energy for (re)generating and maintaining a required vacuum level is optimized.

The term downwards connection indicates a connection between the discharge valve and the vacuum sewer piping that has a downward pipe configuration, whereby an outlet pipe from the source of sewage (e.g. toilet) or the discharge valve leads downwards to the vacuum sewer piping, i.e. a branch pipe, a main pipe line or a collector. In a downwards connection, the transport resistance of the waste is low due to the downwards flow of waste. A lower transport resistance requires a shorter predetermined time for a discharge sequence.

The term upwards connection indicates a connection between the discharge valve and the vacuum sewer piping that has an upward pipe configuration, whereby an outlet pipe from the source of sewage (e.g. toilet) or the discharge valve leads upwards to the vacuum sewer piping, i.e. a branch pipe, a main pipe or a collector. In an upwards connection, the transport resistance of the waste is high due to the upwards flow of waste, i.e. the lift needed to draw the waste up to the vacuum sewer piping. A higher transport resistance requires a longer predetermined time for a discharge sequence.

The upwards connection, i.e. the upward pipe configuration, normally has a given vertical height. Consequently, the given vertical height also influences the transport resistance in the upward pipe configuration, i.e. with a smaller height there is lesser resistance requiring a shorter predetermined time for a discharge sequence and with a bigger height there is more resistance requiring a longer predetermined time for a discharge sequence.

Consequently, in a further advantageous manner, in case the given type of connection of the discharge valve to the vacuum sewer piping is identified as an upwards connection, also called a riser pipe, the predetermined time for a discharge sequence is additionally set according to a predetermined vertical height of the upwards connection.

Additionally or alternatively, a vacuum level is measured at a predetermined point downstream of the discharge valve, whereby the predetermined time for a discharge sequence is additionally set or adjusted according to the measured vacuum level.

A further advantageous approach is to additionally set the predetermined time for a discharge sequence according to an estimated amount or type of waste to be discharged from the source of waste. The amount of waste can be estimated e.g. based on the type of waste that is discharged as well as based on the size of the vacuum waste system in connection with the type of waste to be discharged.

Advantageously, the discharge sequence activating means is provided with a first control means for setting the predetermined time of the discharge sequence. The first control means is manually or automatically controlled depending on the size or type of the vacuum waste system.

Depending on the amount and type of waste to be discharged, the vacuum waste system advantageously further includes a flush water valve, which is connected to a source of flush water. In this case, the method further includes a flushing sequence, which includes an opening and closing of the flush water valve in order to supply a predetermined amount of flush water to the source of waste in connection with the discharge of waste from the source of waste into the vacuum sewer piping.

Advantageously, in case the method includes a flushing sequence, the flushing sequence is also activated by the discharge sequence activating means.

Advantageously, the predetermined time of the flushing sequence is set according to the given type of connection of the discharge valve to the vacuum sewer piping, according to the location of the discharge valve with respect to the to the vacuum sewer piping, the predetermined height of the upwards connection, the measured vacuum level, or the estimated amount or type of waste to be discharged from the source of waste.

This further enhances the control of the vacuum waste system in that it includes a control of the usage of flush water, which in practice firstly leads to a saving of flush water, i.e. a reduction of water consumption, and secondly leads to a reduction of the total amount of waste handled by the vacuum waste system.

Advantageously, the discharge sequence activating means is provided with a second control means for setting the predetermined time of the flushing sequence. The second control means is manually or automatically controlled depending on the size or type of vacuum waste system.

Depending on the type of vacuum waste system, it is advantageous that the discharge sequence activating means is a control mechanism connected to the vacuum sewer piping and the discharge valve.

Alternatively, the discharge sequence activating means is an electrical controller connected to the discharge valve.

In case the vacuum waste system further includes a flush water valve, it is further advantageous that the discharge sequence activating means is a control mechanism connected to the vacuum sewer piping, the discharge valve, and the flush water valve.

Alternatively, in case the vacuum waste system further includes a flush water valve, the discharge sequence activating means is an electrical controller connected to the discharge valve and the flush water valve.

Advantageously, the predetermined time of the discharge sequence and the predetermined time of the flushing sequence are set independently of each other. In this manner the various criteria for both the discharge sequence and the flushing sequence can be taken independently into account, which enhances the optimization of the control of the vacuum waste system.

The method according to the invention is advantageously deployed in connections with various sources of waste, e.g. a vacuum toilet, a urinal, a wash basin, a shower, or a food waste station.

With regard to the present invention the definition "source of waste" is to be understood as comprising a toilet, a urinal, a shower, a wash basin, a food galley, a food waste station, i.e. the conventional sources of waste that are connected to vacuum sewer piping in e.g. buildings, floating structures such as various kinds of marine vessels and offshore constructions, trains, etc.

With regard to the present invention the definition "discharge sequence", which is activated by the discharge sequence activating means, is to be understood as the time range from the opening of the discharge valve to the closing of the discharge valve.

With regard to the present invention the definition "flushing sequence", which is activated by the discharge sequence activating means, is to be understood as the time range from the opening of the flush water valve to the closing of the flush water valve.

Advantageous embodiments of the present invention are given in claims 2-18.

Advantageous embodiments of the vacuum waste system according to the invention of claim 19 are given in claims 20-26.

BRIEF DESCRIPTION OF THE DRAWINGS

In the following, the invention will be described, by way of example only, in more detail with reference to the attached schematic drawings, in which.

DETAILED DESCRIPTION

Figure 1:
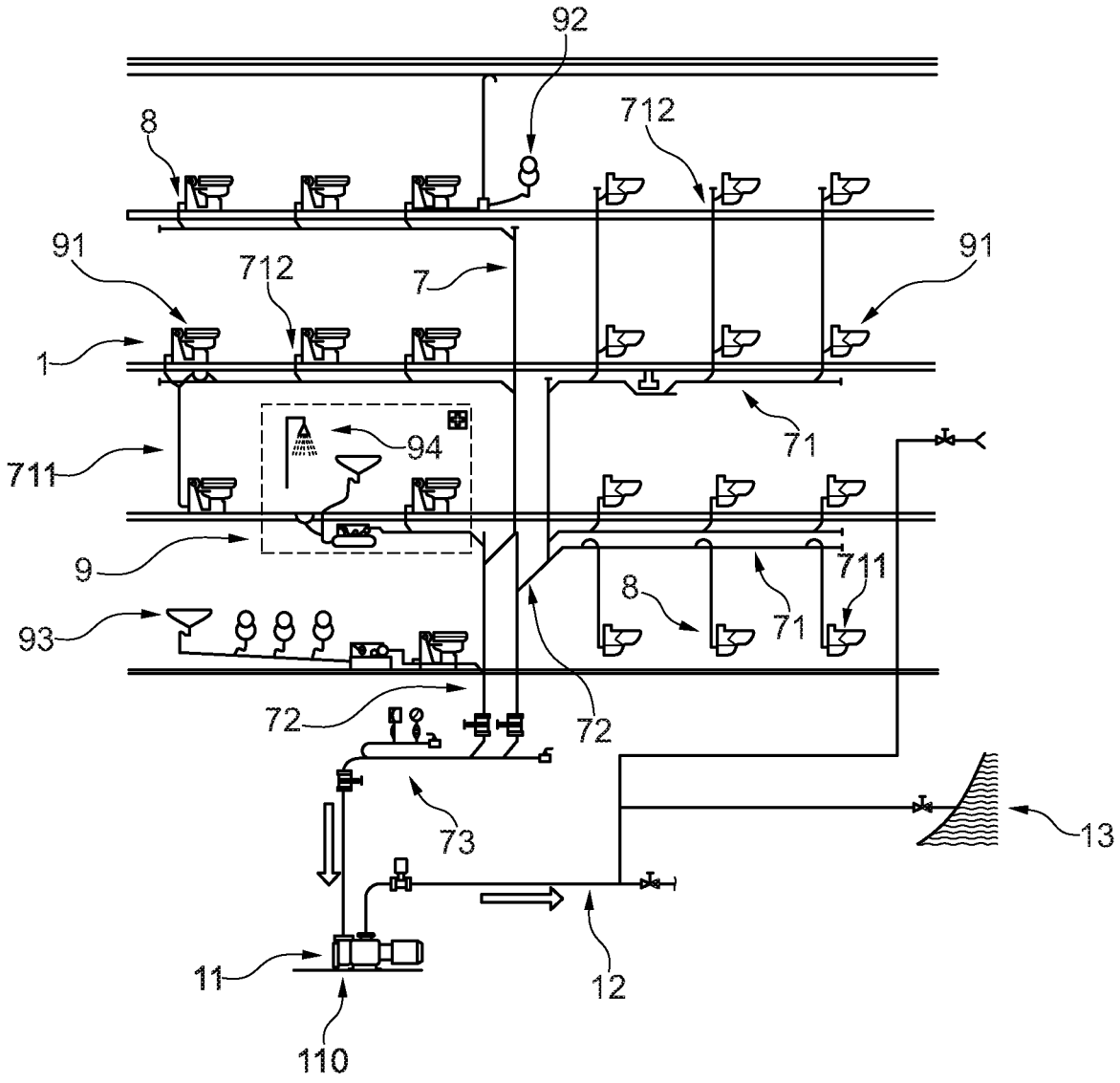
FIG. 1 illustrates a general lay-out of a vacuum waste system.

FIG. 1 illustrates a general lay-out of a vacuum waste system 1. The vacuum waste system comprises a source 9 of sewage, in this embodiment a number of sources of waste, such as a vacuum toilet 91, a urinal 92, a wash basin 93, and a shower 94. The vacuum waste system further comprises vacuum sewer piping 7 including branch pipes 71, main pipe lines 72 and a collector 73. As indicated in FIG. 1, the sources of waste, in this example the vacuum toilets 91, are shown to be connected to the vacuum sewer piping, or in this embodiment to the branch pipes 71, through discharge valves 8, which thus are arranged between the vacuum toilets 91 and the vacuum sewer piping 7. The vacuum toilets are connected to the vacuum sewer piping 7, i.e. the branch pipes 71, by a given type of connection, which usually is in the form of an upwards connection, i.e. an upward pipe configuration from the toilet to the branch pipes, as indicated by reference numeral 711, or a downwards connection, i.e. a downward pipe configuration from the toilet to the branch pipes, as indicated by reference numeral 712.

A vacuum unit 11, which in this embodiment is illustrated as a vacuum pump 110, is connected to the collector 73 for generating vacuum and for pumping a flow of waste in the vacuum sewer piping 7 of the vacuum waste system 1. The vacuum unit 1 is further connected to a discharge pipe 12 for discharging the flow of waste to a receiving facility 13. The vacuum unit can alternatively also be in the form of e.g. an ejector unit, a combination of vacuum pump and a discharge pump, with our without a separate vacuum tank, etc. The type of vacuum unit can be chosen as found appropriate. For a vacuum waste system e.g. aboard a marine vessel, the receiving facility could be e.g. a surrounding sea, a storage tank or a treatment plant.

Figure 2:
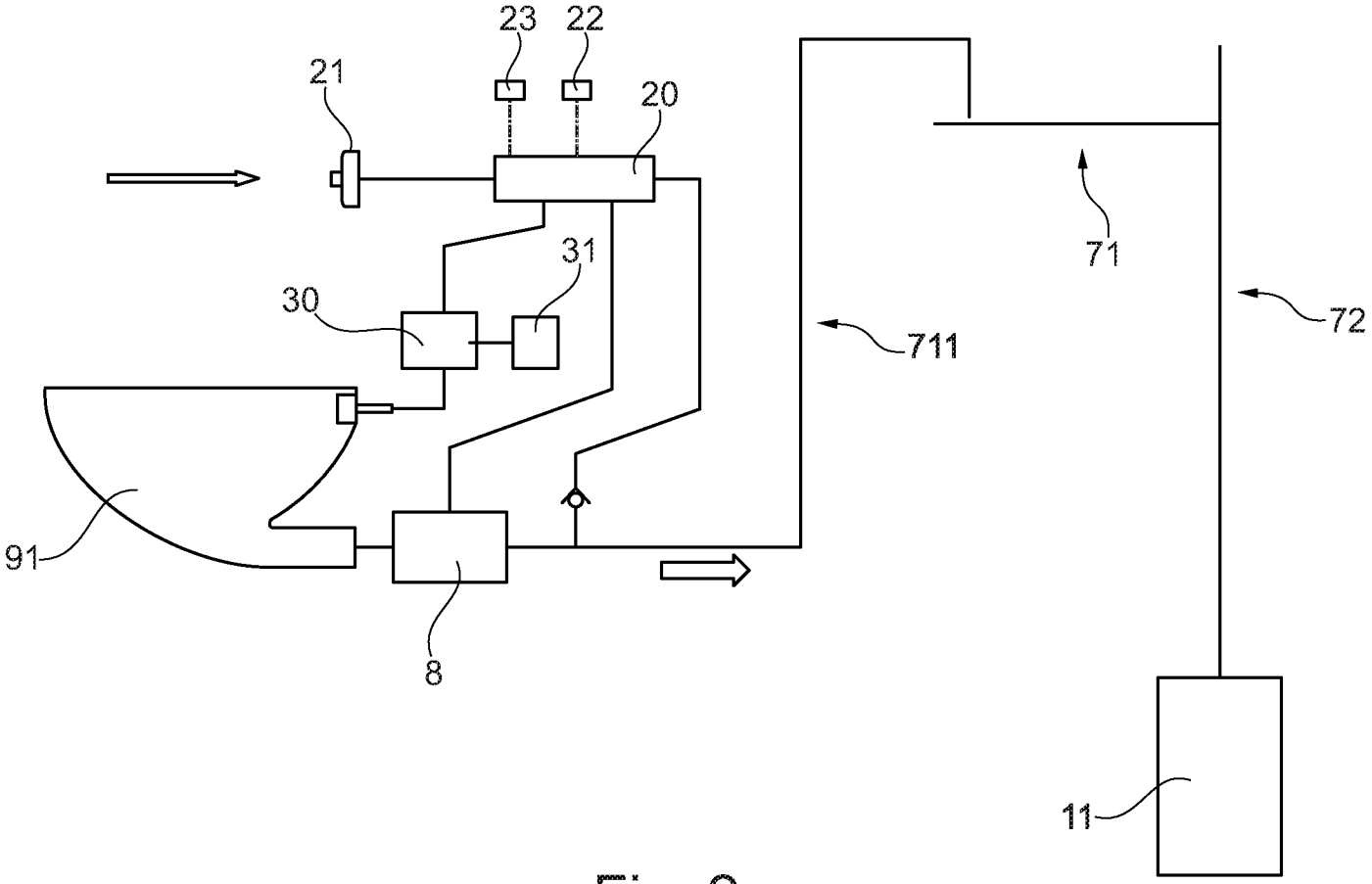
FIG. 2 illustrates an example of a connection of a source of sewage, in this case a vacuum toilet, to the vacuum sewer.

In order to provide a more detailed example of the connection of a source of waste to the vacuum waste system, FIG. 2 illustrates a simplified connection for a vacuum toilet in a vacuum waste system as illustrated in FIG. 1.

The source of sewage, in this case the vacuum toilet 91, is provided with a toilet bowl outlet connected to an inlet end of the discharge valve 8. An outlet end of the discharge valve 8 is provided with a given type of connection to a branch pipe 71 of the vacuum sewer piping 7. In this case the given type of connection is shown as an upwards connection 711, i.e. an upward pipe configuration.

The vacuum sewer piping 7 is connected to the vacuum unit 11. The operation of the discharge valve 8 is controlled by a discharge sequence activating means 20, in this case a so-called control mechanism, provided with at least one push button 21. The control mechanism is a pneumatic control mechanism. The discharge valve 8 is a vacuum operated discharge valve.

The discharge sequence includes an opening and closing of the discharge valve 8 for the discharge of waste form the vacuum toilet 91 into the vacuum sewer piping 7. The discharge sequence, i.e. the opening of the discharge valve, is activated by the control mechanism. In practice, the discharge valve is set to close after a preset delay.

The vacuum waste system further includes a flush water valve 30 connected to a source of flush water 31 in order to supply flush water to the vacuum toilet 91 in connection with the discharge of waste from the source of waste, i.e. the vacuum toilet 91, into the vacuum sewer piping 7. The supply of flush water is carried out in a flushing sequence in connection with the discharge sequence.

The flushing sequence includes an opening and closing of the flush water valve 30 in order to supply a predetermined amount of flush water to the vacuum toilet 91 in connection with the discharge of waste into the vacuum sewer piping 7. The flushing sequence, i.e. the opening of the flush water valve, is activated by the control mechanism. In practice, the flush water valve is set to close after a preset delay.

The discharge sequence activating means 20, i.e. the control mechanism, is connected to the vacuum sewer piping, in this example to the upwards connection 711, i.e.

an upward pipe configuration, as illustrated in FIG. 2, the discharge valve 8 and the flush water valve 30, which are pneumatically operated by the control mechanism using the vacuum available in the vacuum sewer piping. By pressing the push button 21 (indicated by an open block arrow), the discharge sequence and the flushing sequence are activated by the control mechanism, whereby the discharge sequence is set for a predetermined time and the flushing sequence is set for a predetermined time during which the waste, the flush water and atmospheric air is discharged into the vacuum sewer piping from the vacuum toilet.

Figure 4:
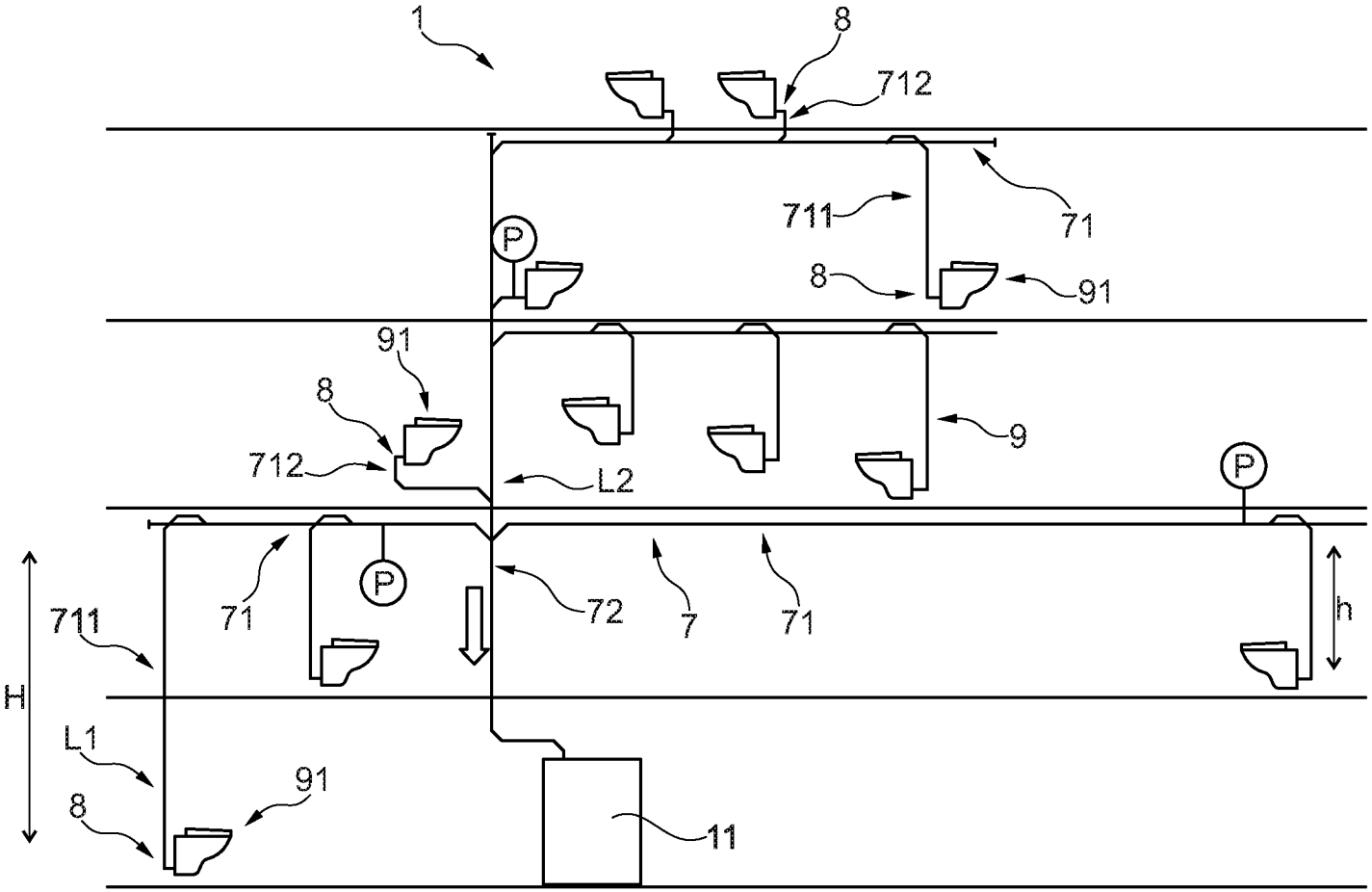
FIG. 4 illustrates a general lay-out of a vacuum waste system with vacuum toilets.
Figure 5:
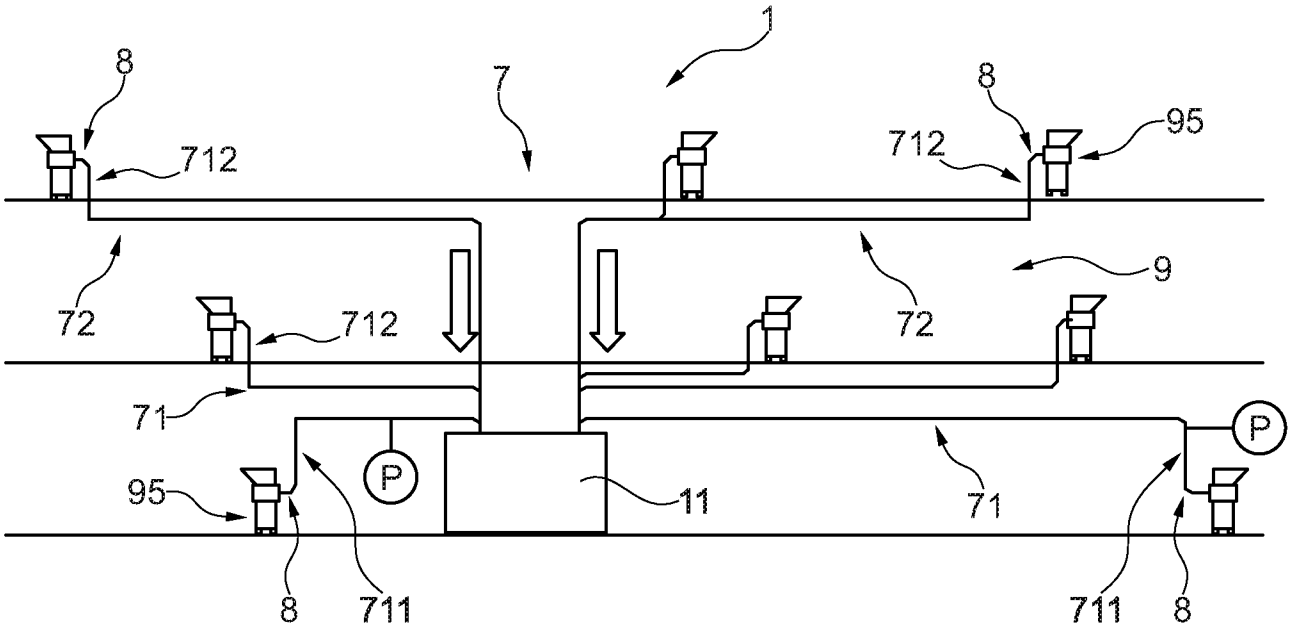
FIG. 5 illustrates a general lay-out of a vacuum waste system with food waste stations.

The predetermined time of the discharge sequence is set according to the given type of connection of the discharge valve to the vacuum sewer piping, i.e. an upwards connection, i.e. an upward pipe configuration, or downwards connection, i.e. a downward pipe configuration, according to the location, i.e. the distance between the discharge valve and the vacuum unit, of the discharge valve with respect to the vacuum sewer piping, the predetermined vertical height of the upwards connection, the measured vacuum level, or the estimated amount or type of waste to be discharged from the source of waste as discussed in more detail below in connection with FIG. 4 and FIG. 5.

The discharge sequence activating means is provided with a first control means 22 for setting the predetermined time of the discharge sequence. The first control means is manually or automatically controlled.

The predetermined time of the flushing sequence is set according to the given type of connection of the discharge valve to the vacuum sewer piping, i.e. an upwards or downwards connection, according to the location of the discharge valve with respect to the vacuum sewer piping, the predetermined vertical height of the upwards connection, the measured vacuum level, or the estimated amount or type of waste to be discharged from the source of waste.

The discharge sequence activating means is provided with a second control means 23 for setting the predetermined time of the flushing sequence. The second control means is manually or automatically controlled.

The predetermined time of the discharge sequence and the predetermined time of the flushing sequence are advantageously set independently of each other. These can thus be varied as found appropriate. This can be illustrated by way of some examples as follows.

If the source of waste is a vacuum toilet, the flush water valve is normally closed within some delay after the discharge valve has closed in order to continue the supply of flush water after the discharge sequence is terminated so that a small pool of water is formed in the toilet bowl for the next discharge sequence.

In case of a urinal, such an additional supply of water is not required, whereby the flush water flow can be terminated earlier. This leads to a saving of flush water, i.e. a reduction of flush water consumption as well as a reduction of the total amount of waste to be handled by the vacuum waste system.

In a corresponding manner, a vacuum toilet can be provided e.g. with a dual push button or with two push buttons, one for a short discharge sequence and flushing sequence and one for a long discharge sequence and flushing sequence depending on the type of waste to be discharged. The discharge sequence activating means can also be of a more sophisticated type, e.g. a sensor based system.

If desired, the opening of the flush water valve can also be set to be before the opening of the discharge valve, in case there is a need to flush the source of waste before the actual discharge sequence. This is normally done e.g. in connection with food waste stations, where the food waste receptacle may be flushed before and in connection with the supply of food waste even before the actual discharge sequence. An example of a vacuum food waste system with food waste stations is discussed below in connection with FIG. 5.

Consequently, the method according to the present invention allows to set both the predetermined time of the discharge sequence and the flushing sequence of each individual source of waste in the vacuum waste system. This gives an optimized control of the vacuum waste system with regard to energy consumption, consumption of flush water and the control of the amount of waste to be handled by the vacuum waste system.

The latter further leads to advantages in the further processing of the waste, e.g. storage capacity reduction, lowered contamination problems and thus also cost reductions.

The suction of air into the vacuum sewer piping during the discharge sequence also causes noise, which is related to the length of the discharge sequence. A shorter discharge sequence results in less noise than a longer discharge sequence.

In case the source of waste is a urinal, a wash basin, or a shower, normally a so-called interface unit is arranged between the source of waste or the outlet of the source of waste and the discharge valve. The interface unit collects a certain amount of waste, whereby the interface unit, at a given fill degree of the interface unit, is activated by means of a sensor unit in order to activate the discharge sequence and to discharge the waste into the vacuum sewer piping.

The discharge sequence and the flushing sequence can thus be adapted as desired for the prevailing circumstances.

The direction of the flow of waste is indicated by a block arrow.

Figure 3:
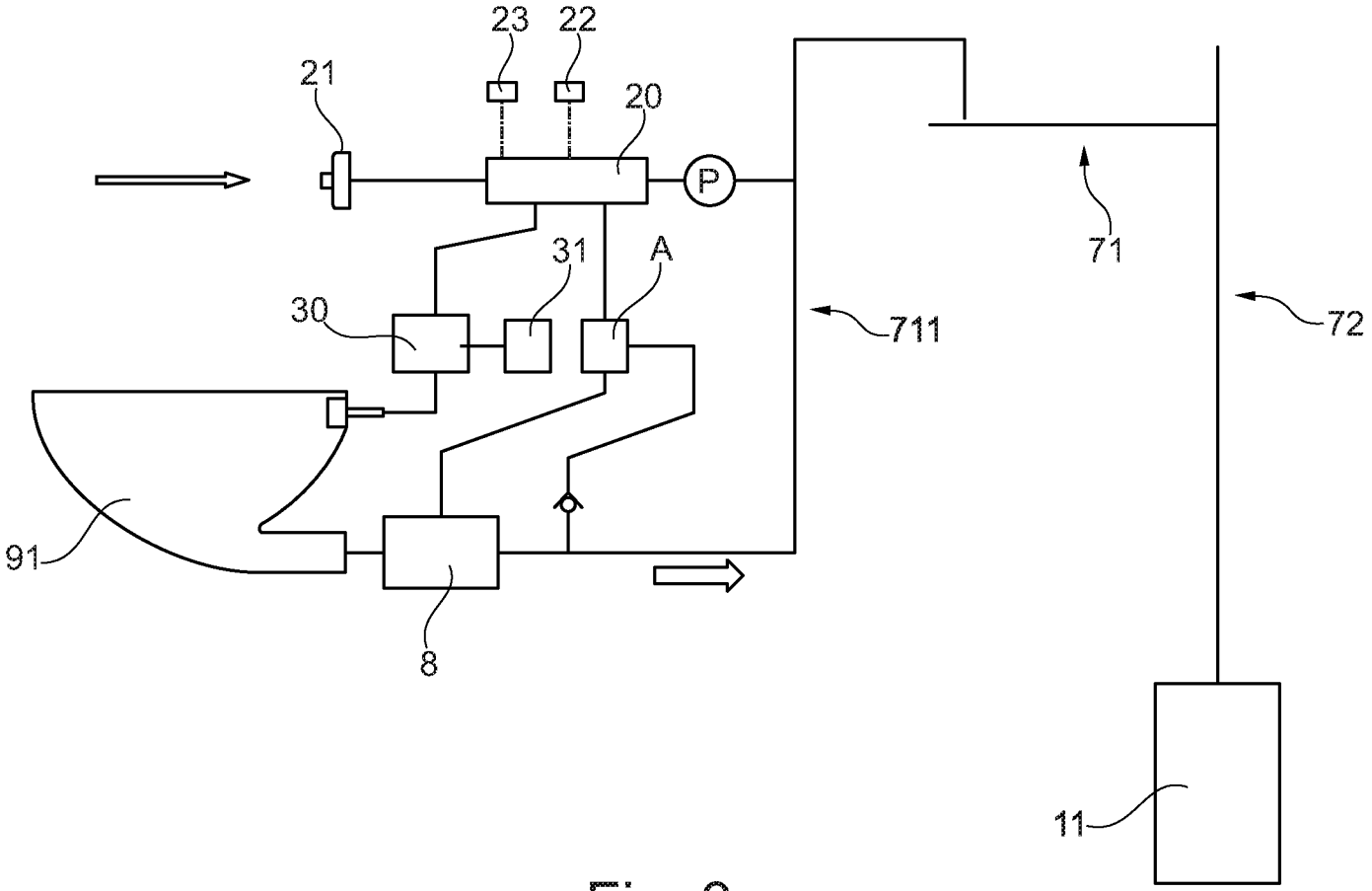
FIG. 3 illustrates another example of a connection of a source of sewage, in this case a vacuum toilet, to the vacuum sewer.

In order to provide another more detailed example of the connection of a source of waste to the vacuum waste system, FIG. 3 illustrates a simplified connection for a vacuum toilet in a vacuum waste system as illustrated in FIG. 1. The example according to FIG. 3 differs from the example according to FIG. 2 in that the discharge sequence activating means 20 is electrically governed comprising an electrical control unit.

The source of sewage 9, in this case the vacuum toilet 91, is provided with a toilet bowl outlet connected to an inlet end of the discharge valve 8. An outlet end of the discharge valve 8 is provided with a given type of connection to a branch pipe 71 of the vacuum sewer piping 7. In this case the given type of connection is shown as an upwards connection 711, i.e. an upward pipe configuration.

The vacuum sewer piping 7 is connected to the vacuum unit 11. The operation of the discharge valve 8 is controlled by a discharge sequence activating means 20, in this case by the electrical control unit, provided with at least one push button 21, in this case an electrical push button, e.g. a membrane switch.

The discharge sequence includes an opening and closing of the discharge valve 8 for the discharge of waste form the vacuum toilet 91 into the vacuum sewer piping 7. The discharge sequence, i.e. the opening of the discharge valve, is activated by the electrical control unit.

The vacuum waste system further includes a flush water valve 30 connected to a source of flush water 31 in order to supply flush water to the vacuum toilet 91 in connection with the discharge of waste from the source of waste, i.e. the vacuum toilet 91, into the vacuum sewer piping 7. The supply of flush water is carried out in a flushing sequence in connection with the discharge sequence.

The flushing sequence includes an opening and closing of the flush water valve 30 in order to supply a predetermined amount of flush water to the vacuum toilet 91 in connection with the discharge of waste into the vacuum sewer piping 7.

The discharge sequence activating means 20, i.e. the electrical control unit, is connected to the discharge valve 8 through a pilot valve (e.g. an electrical solenoid valve) A. The discharge valve 8 is a vacuum operated discharge valve. When the discharge sequence is activated, the pilot valve A receives a signal from the electrical control unit, whereby a connection from the vacuum sewer piping is opened to the discharge valve for providing vacuum to the discharge valve for opening the same.

The electrical control unit is connected directly to the flush water valve 30, in this case an electrical water valve (e.g. a solenoid valve). By pressing the push button 21 (indicated by an open block arrow), the discharge sequence and the flushing sequence are activated by the electrical control unit, whereby the discharge sequence is set for a predetermined time and the flushing sequence is set for a predetermined time during which the waste, the flush water and atmospheric air is discharged into the vacuum sewer piping from the vacuum toilet.

The predetermined time of the discharge sequence is set or adjusted according to the given type of connection of the discharge valve to the vacuum sewer piping, i.e. an upwards connection, i.e. an upward pipe configuration, or downwards connection, i.e. a downward pipe configuration, according to the location, i.e. the distance between the discharge valve and the vacuum unit, of the discharge valve with respect to the vacuum sewer piping, the predetermined vertical height of the upwards connection, the measured vacuum level, or the estimated amount or type of waste to be discharged from the source of waste as discussed in more detail below in connection with FIG. 4.

The discharge sequence activating means is provided with a first control means 22 for setting and adjusting the predetermined time of the discharge sequence. The first control means is manually or automatically controlled.

The predetermined time of the flushing sequence is set according to the given type of connection of the discharge valve to the vacuum sewer piping, i.e. an upwards or downwards connection, according to the location of the discharge valve with respect to the vacuum sewer piping, the predetermined vertical height of the upwards connection, the measured vacuum level, or the estimated amount or type of waste to be discharged from the source of waste.

The discharge sequence activating means is provided with a second control means 23 for setting the predetermined time of the flushing sequence. The second control means is manually or automatically controlled.

The predetermined time of the discharge sequence and the predetermined time of the flushing sequence are advantageously set independently of each other. These can thus be varied as found appropriate. This can be illustrated by way of some examples as follows.

If the source of waste is a vacuum toilet, the flush water valve is normally closed within some delay after the discharge valve has closed in order to continue the supply of flush water after the discharge sequence is terminated so that a small pool of water is formed in the toilet bowl for the next discharge sequence.

In case of a urinal, such an additional supply of water is not required, whereby the flush water flow can be terminated earlier. This leads to a saving of flush water, i.e. a reduction of flush water consumption as well as a reduction of the total amount of waste to be handled by the vacuum waste system.

In a corresponding manner, a vacuum toilet can be provided e.g. with a dual push button or with two push buttons, one for a short discharge sequence and flushing sequence and one for a longer discharge sequence and flushing sequence depending on the type of waste to be discharged. The discharge sequence activating means can also be a more sophisticated type, e.g. a sensor based system.

If desired, the opening of the flush water valve can also be set to be before the opening of the discharge valve, in case there is a need to flush the source of waste before the actual discharge sequence. This is normally done e.g. in connection with food waste stations, where the food waste receptacle may be flushed before and in connection with the supply of food waste even before the actual discharge sequence. An example of a vacuum food waste system with food waste stations is discussed below in connection with FIG. 5.

Consequently, the method according to the present invention allows to set both the predetermined time of the discharge sequence and the flushing sequence of each individual source of waste in the vacuum waste system. This gives an optimized control of the vacuum waste system with regard to energy consumption, consumption of flush water and the control of the amount of waste to be handled by the vacuum waste system.

The latter further leads to advantages in the further processing of the waste, e.g. storage capacity reduction, lowered contamination problems and thus also cost reductions.

The suction of air into the vacuum sewer piping during the discharge sequence also causes noise, which is related to the length of the discharge sequence. A shorter discharge sequence results in less noise than a longer discharge sequence.

In case the source of waste is a urinal, a wash basin, or a shower, normally a so-called interface unit is arranged between the source of waste or the outlet of the source of waste and the discharge valve. The interface unit collects a certain amount of waste, whereby the interface unit, at a given fill degree of the interface unit, is activated by means of a sensor unit in order to activate the discharge sequence and to discharge the waste into the vacuum sewer piping.

The discharge sequence and the flushing sequence can thus be adapted as desired for the prevailing circumstances.

The direction of the flow of waste is indicated by a block arrow.

In a typical transport function of a vacuum waste system, particularly a vacuum toilet system as described above, waste is transported through the vacuum sewer piping in discrete slugs with intermediate large volumes of air forming a non-homogenous flow of waste.

When a discharge sequence for the vacuum toilet is activated by the discharge sequence activating means 20, i.e. the control mechanism or the electrical controller, the discharge valve 8 between the vacuum toilet 91 and the vacuum sewer piping 7 is opened, and the vacuum prevailing in the vacuum sewer piping draws out the waste and flush water from the vacuum toilet into the vacuum sewer piping. Only a small amount of flush water is needed, as compared to a normal gravity toilet system, due to the strong suction effect of the vacuum sewer piping and the atmospheric pressure prevailing in (and around) the vacuum toilet. The amount of waste and flush water is typically about 1.5-2 liters. For a normal gravity toilet system the amount of flush water is on average 6-10 liters.

Consequently, there is a pressure difference, i.e. atmospheric pressure on the vacuum toilet side of the waste and flush water and vacuum, or more exactly a partial vacuum, on the vacuum sewer piping side of the waste and flush water, when the discharge valve opens. The transport of waste and flush water takes place due to this pressure difference, whereby the waste and flush water forms a discrete slug followed by a large amount of air, e.g. about 1-2 liters of waste and flush water followed by about 60 liters of air, i.e. a waste and flush water in a ratio of about 1:30 to air. A large amount of air is thus sucked or forced into the vacuum sewer piping during the time the discharge valve remains open for the set predetermined time of the discharge sequence. Basically, the transport of waste in a vacuum sewer piping takes place as a train of discrete slugs with air pockets in between.

In order to function appropriately, the vacuum level in the vacuum waste system, or more exactly in the vacuum sewer piping, has to be at a certain level. Normally, a required lower vacuum level is −0.3 bar and a required upper vacuum level is −0.6 bar. The vacuum level is maintained by the vacuum unit, which, when the lower vacuum level is reached, is started and (re)generates the vacuum level up to the required higher level.

When atmospheric air is sucked into the vacuum sewer piping, the vacuum level is lowered. Thus, the vacuum level decreases corresponding to the amount of atmospheric air sucked into the vacuum sewer piping. As a result, the running time, and also the start-up frequency as mentioned above, of the vacuum unit, in order to (re)generate and maintain the required vacuum level in the vacuum sewer piping, is dependent on the consumption of vacuum in the vacuum sewer piping.

The suction of air into the vacuum sewer piping during the discharge sequence also causes noise, which is related to the length of the discharge sequence. A shorter discharge sequence results in less noise than a longer discharge sequence.

Vacuum waste systems in general are known to a person skilled in the art and are therefore not discussed in greater deal in this connection.

The direction of the flow of waste is indicated with block arrows.

The method of controlling a vacuum waste system according to the present invention will be described by way of some examples in the following in connection with FIG. 4.

In the schematically illustrated general lay-out of a vacuum toilet system shown in FIG. 4, the reference numerals for the components of the vacuum waste system correspond to those used in connection with FIG. 1, FIG. 2 and FIG. 3.

The vacuum waste system 1 includes a source of waste, in this embodiment a number of vacuum toilets 91. An inlet end of a discharge valve 8 is connected to the vacuum toilet 91. An outlet end of the discharge valve 8 is connected to the vacuum sewer piping 7 with a given type of connection (as shown in more detail in FIG. 2 and FIG. 3). In practice the given type of connection is either a downwards connection 712, i.e. a downward pipe configuration, or an upwards connection 711, i.e. an upward pipe configuration, whereby the connection is to a branch pipe 71 of the vacuum sewer piping 7. The branch pipes are connected to a main pipe line 72. A downwards connection or an upwards connection from the vacuum toilet can also be directly to the main pipe line 72. Vacuum in the vacuum waste network is generated by a vacuum unit 11.

In order to discharge the waste from the vacuum toilet 91, a discharge sequence is initiated by means of a discharge sequence activating means 20 (as described in connection with FIG. 2 and FIG. 3). The discharge sequence is set for a predetermined time (the time from the opening of the discharge valve to the closing of the discharge valve).

In order to arrive at an as close to optimal predetermined time of a discharge sequence, the predetermined time is set according to the given type of connection between the discharge valve 8 and the vacuum sewer piping 7, i.e. in this case a main pipe line 72 or a branch pipe 71. The given type of connection can be e.g. a downwards connection 712 or an upwards connection 711.

As described above, an upwards connection requires a longer discharge sequence than a downwards connection. Consequently, in order to arrive at a desired predetermined time for the discharge sequence, the given type of connection is firstly identified as a downwards connection 712 or an upwards connection 711. Further, if the given type of connection is identified as an upwards connection 711, the predetermined time is additionally set according to a predetermined vertical height of the upwards connection 711. An example of a more limited (lower) height is illustrated in FIG. 4 with reference h and a more considerably (higher) height is illustrated in FIG. 4 with reference H. A higher (H) upwards connection 711 requires a longer discharge sequence than a lower (h) upwards connection 711 due to an increased transport resistance in a higher upwards connection as compared to the transport resistance in a lower upwards connection.

The influence of the given type of connection or the vertical height of an upwards connection on the required time for a discharge sequence, can be exemplified as follows.

| | Required time of discharge sequence | Discharge sequence time reduction % |
|---|---|---|
| Downwards connection | | |
| 0 m | 2 sec | 20% |
| Upwards connection | | |
| 1 m | 2.2 sec | 12% |
| 2 m | 2.35 sec | 6% |
| 3 m | 2.5 sec | 0% |
| 4 m | 2.65 sec | −6% |
| 5 m | 2.8 sec | −12% |

As mentioned above, in a conventional vacuum waste system the predetermined and fixed time of the discharge sequence is set in order to ensure a complete discharge of waste at a point farthest away from the vacuum unit and with an upwards connection to the vacuum sewer piping. This is exemplified in the above table in the line with 3 m-2.5 sec-0%, which is given as a reference value.

In the above upper table, when the predetermined discharge sequence is set for a downwards connection, there is a 20% reduction in the discharge time, which reduces energy consumption. The above lower table shows corresponding values for various settings.

Consequently, the setting of the predetermined time of the discharge sequence is clearly dependent on the given type of connection, and in case of an upwards connection, on the vertical height of the upwards connection. By taking into account these factors, the consumption of vacuum in the vacuum sewer piping can clearly be reduced or controlled, whereby the control of the energy consumption in the vacuum waste system can be optimized.

Alternatively the predetermined time can be set according to the location, i.e. the distance between the discharge valve and the vacuum unit, of the discharge valve with respect to the vacuum sewer piping (in practice the distance between the vacuum unit and the discharge valve). L1, as indicated in FIG. 4, illustrates an example of a location farther away, i.e. a longer distance, from the vacuum unit 11 and L2, as indicated in FIG. 4, illustrates an example of a location closer, i.e. a shorter distance, to the vacuum unit 11. The vacuum level prevailing at a location farther away (L1), i.e. at a longer distance from the vacuum unit 11 is usually lower than the vacuum level prevailing at a location closer (L2), i.e. at a shorter distance to the vacuum unit 11. As described above, a lower vacuum level requires a longer discharge sequence than a higher vacuum level. Thus, the predetermined time of the discharge sequence can be set according to these criteria.

Alternatively or additionally to taking into consideration the location, the vacuum level can be measured at a predetermined point downstream (direction of the flow of waste is shown by block arrows) of the discharge valve 8, whereby the predetermined time for a discharge sequence is additionally set according to the measured vacuum level. The measuring can be carried out by means of pressure sensors P, as indicated in FIG. 4, placed at said predetermined points.

In the example discussed above in connection with FIG. 3, in which the discharge sequence activating means 20 is an electrical control unit, the pressure measuring by a pressure sensor P can be automatically connected to the electrical control unit as illustrated in FIG. 3, whereby the predetermined time of the discharge sequence is self-adjusting based on the prevailing vacuum level. This is of course applicable as well to the flushing sequence.

The influence of the location, i.e. the distance between the discharge valve and the vacuum unit, in practice the prevailing vacuum level, or the influence of the measured vacuum level at predetermined points downstream of the discharge valves on the required time for a discharge sequence, can be exemplified as follows.

| Vacuum level | Required time of discharge sequence | Discharge sequence time reduction % |
|---|---|---|
| −0.3 bar | 2.5 sec | 0% |
| −0.4 bar | 2.3 sec | 8% |
| −0.5 bar | 2.1 sec | 16% |
| −0.6 bar | 2.0 sec | 20% |

As mentioned above, in a conventional vacuum waste system the predetermined and fixed time of the discharge sequence is set in order to ensure a complete discharge of waste at a point farthest away from the vacuum unit and with an upwards connection to the vacuum sewer piping. This is exemplified in the above table in the line with −0.3 bar-2.5 sec-0%, which is given as a reference value.

In the above table, the point farthest away, representing a longest distance between the discharge valve and the vacuum unit, is given as the lowest vacuum level −0.3 bar. By setting the discharge time according to the location, i.e. the distance between the discharge valve and the vacuum unit, of the discharge valve with respect to the vacuum sewer piping, in other words the prevailing vacuum level, a discharge time reduction can be achieved, which reduces energy consumption. The above table shows corresponding values for various settings.

Consequently, the setting of the predetermined time of the discharge sequence is clearly dependent on the prevailing vacuum level. By taking into account the location or the measured vacuum level, the consumption of the vacuum in the vacuum sewer piping can clearly be reduced or controlled, whereby the control of the energy consumption in the vacuum waste system can be optimized.

Further, the predetermined time for a discharge sequence can be additionally set according to an estimated amount or type of waste to be discharged from the source of waste. For illustrative purposes can be noted that e.g. an average amount of waste from a urinal is generally smaller than an average amount of waste from a vacuum toilet. In a corresponding manner, an average amount of waste from a wash basin is generally smaller than an average amount of waste from a shower.

In the same manner, an average amount of waste from a smaller food waste system (e.g. deployed on a yacht) is generally smaller than the average amount of waste from a larger food waste system (e.g. deployed on a cruise vessel). An example of a food waste system is discussed below in connection with FIG. 5.

The average amount of waste from a given type of source of waste can also be quantified empirically, whereby e.g. given averages can be used for setting the predetermined time of the discharge sequence.

The discharge sequence activating means is provided with a first control means 22 (FIG. 2 and FIG. 3) for setting the predetermined time of the discharge sequence. The first control means is manually or automatically controlled.

In case the vacuum waste system includes a flush water valve, the predetermined time of the flushing sequence is set according to the given type of connection of the discharge valve to the vacuum sewer piping, i.e. an upwards or downwards connection, according to the location of the discharge valve with respect to the vacuum sewer piping, the predetermined vertical height of the upwards connection, the measured vacuum level, or the estimated amount or type of waste to be discharged from the source of waste as discussed in more detail in connection with FIG. 2 and FIG. 3 above.

This further enhances the control of the vacuum waste system in that it includes a control of the usage of flush water, which in practice firstly leads to a saving of flush water, i.e. a reduction of water consumption, and secondly leads to a reduction of the total amount of waste handled by the vacuum waste system. This also reduces energy consumption in the vacuum waste system.

The discharge sequence activating means is provided with a second control means 23 (FIG. 2 and FIG. 3) for setting the predetermined time of the flushing sequence. The second control means is manually or automatically controlled.

Particularly for automatic control, collected data can include: vacuum level, discharge sequence time, water pressure, water consumption, number of discharge sequences, number of flushing sequences, etc.

The method of controlling a vacuum waste system according to the present invention will also be described by way of an example in the following in connection with FIG. 5.

In the schematically illustrated general lay-out of a vacuum food waste system with food waste stations shown in FIG. 5, the reference numerals for the components of the vacuum waste system correspond to those used in connection with FIG. 1, FIG. 2, FIG. 3 and FIG. 4.

The vacuum waste system 1 includes a source of waste 9, in this embodiment a number of food waste stations 95. An inlet end of a discharge valve 8 is connected to the food waste station 95. An outlet end of the discharge valve 8 is connected to the vacuum sewer piping 7 with a given type of connection (as shown in more detail in FIG. 2 and FIG. 3). In practice the given type of connection is either a downwards connection 712, i.e. a downward pipe configuration, or an upwards connection 711, i.e. an upward pipe configuration, whereby the connection is to a branch pipe 71 of the vacuum sewer piping 7. The branch pipes are connected to a main pipe line 72. A downwards connection or an upwards connection from the food waste station can also be directly to the main pipe line 72. Vacuum in the vacuum waste network is generated by a vacuum unit 11.

In order to discharge the waste from the food waste station 95, a discharge sequence is initiated by means of a discharge sequence activating means 20 (as described in connection with FIG. 2 and FIG. 3). The discharge sequence is set for a predetermined time (the time from the opening of the discharge valve to the closing of the discharge valve). In this regard, a food waste station 95 has the same functioning principle as a vacuum toilet.

In order to arrive at an as close to optimal predetermined time of a discharge sequence, the predetermined time is set according to the given type of connection between the discharge valve 8 and the vacuum sewer piping 7, i.e. in this case a main pipe line 72 or a branch pipe 71. The given type of connection can be e.g. a downwards connection 712 or an upwards connection 711.

As described above, an upwards connection requires a longer discharge sequence than a downwards connection. Consequently, in order to arrive at a desired predetermined time for the discharge sequence, the given type of connection is firstly identified as a downwards connection 712 or an upwards connection 711. Further, if the given type of connection is identified as an upwards connection 711, the predetermined time is additionally set according to a predetermined vertical height of the upwards connection 711 as discussed in connection with FIG. 4.

Although not separately shown and discussed in more detail in this connection, the same principles apply as in connection with a vacuum toilet as discussed above in connection with FIG. 4.

Alternatively the predetermined time can be set according to the location, i.e. the distance between the discharge valve and the vacuum unit, of the discharge valve with respect to the vacuum sewer piping (in practice the distance between the vacuum unit and the discharge valve) as discussed in connection with FIG. 4.

Alternatively or additionally to taking into consideration the location, the vacuum level can be measured at a predetermined point downstream (direction of the waste as shown by bolded arrow) of the discharge valve 8, whereby the predetermined time for a discharge sequence is additionally set according to the measured vacuum level. The measuring can be carried out by means of pressure sensors P, as indicated in FIG. 5, placed at said predetermined points.

Although not separately shown and discussed in more detail in this connection, the same advantages and principles apply as in connection with a vacuum toilet system as discussed above in connection with FIG. 4.

The discharge sequence activating means is provided with a first control means 22 (FIG. 2 and FIG. 3) for setting the predetermined time of the discharge sequence. The first control means is manually or automatically controlled.

In case the vacuum waste system includes a flush water valve, the predetermined time of the flushing sequence is set according to the given type of connection of the discharge valve to the vacuum sewer piping, i.e. an upwards or downwards connection, according to the location of the discharge valve with respect to the vacuum sewer piping, the predetermined vertical height of the upwards connection, the measured vacuum level, or the estimated amount or type of waste to be discharged from the source of waste as discussed in more detail in connection with FIG. 2 and FIG. 3 above.

This further enhances the control of the vacuum waste system in that it includes a control of the usage of flush water, which in practice firstly leads to a saving of flush water, i.e. a reduction of water consumption, and secondly leads to a reduction of the total amount of waste handled by the vacuum waste system. This also reduces energy consumption in the vacuum waste system.

The discharge sequence activating means is provided with a second control means 23 (FIG. 2 and FIG. 3) for setting the predetermined time of the flushing sequence. The second control means is manually or automatically controlled.

The discharge sequence and the flushing sequence can thus be adapted as desired for the prevailing circumstances and the type of the source of waste.

In connection with a food waste station, the discharge sequence and the flushing sequence can be repeated a number of times depending e.g. on the amount and type of food waste that is handled.

Additionally, a discharge sequence in a food waste system is generally longer than e.g. in a vacuum toilet system. This is because in a food waste system, the waste often is transported as close as possible or even all the way to the vacuum unit, or the corresponding unit, in one phase. However, the same principles for setting both the discharge sequence and the flushing sequence are nonetheless applicable.

The discharge sequence and the flushing sequence can thus be adapted as desired for the prevailing circumstances and the type of the source of waste.

The drawings and the description related thereto are only intended for clarification of the basic idea of the invention. The invention may vary in detail within the scope of the ensuing claims.

The invention claimed is:

1. A method of controlling a vacuum waste system, wherein the vacuum waste system comprises a first source of waste and a second source of waste, a vacuum unit configured to generate a vacuum, vacuum sewer piping comprising a main pipe line coupled to the vacuum unit, a first branch pipe coupled to the main pipe line, a second branch pipe coupled to the main pipe line, a first discharge valve coupled between the first source of waste and the first branch pipe, a second discharge valve coupled between the second source of waste and the second branch pipe, wherein a first connection configuration of the first source of waste and the first branch pipe comprises either a downwards connection configuration or an upwards connection configuration, a second connection configuration of the second source of waste and the second branch pipe comprises either a downwards connection or an upwards connection, a first discharge sequence activator is operably coupled to the first discharge valve, and a second discharge sequence activator is operably coupled to the second discharge valve, the method comprising:

determining a first pre-set discharge time period based, at least in part, according to:

the first connection configuration between the first discharge valve and the first branch pipe; and a first distance between the first discharge valve and the vacuum unit;

determining a second pre-set discharge time period based, at least in part, according to:

the second connection configuration between the second discharge valve and the second branch pipe; and a second distance between the second discharge valve and the vacuum unit;

wherein the second pre-set discharge time period is different than the first pre-set discharge time period;

generating the vacuum in the vacuum sewer piping by the vacuum unit;

measuring a first vacuum level at a first point downstream of the first discharge valve;

measuring a second vacuum level at a second point downstream of the second discharge valve, wherein the second point is different than the first point;

reducing the first pre-set discharge time period based on the first vacuum level to determine a first modified pre-set discharge time period;

reducing the second pre-set discharge time period based on the second vacuum level to determine a second modified pre-set discharge time period;

operating the first discharge sequence activator to actuate the first discharge valve to execute a first discharge valve sequence, in which the first discharge valve is actuated from a closed position to an open position, the first discharge valve remains open for the first modified pre-set discharge time period, and then the first discharge valve is actuated from the open position to the closed position; and operating the second discharge valve activator to actuate the second discharge valve to execute a second discharge valve sequence, in which the second discharge valve is actuated from a closed position to an open position, the second discharge valve remains open for the second modified pre-set discharge time period, and then the second discharge valve is actuated from the open position to the closed position.

2. The method of claim 1, wherein, the first connection configuration comprises the upwards connection configuration, and determining the first pre-set discharge time period further is based on a vertical height of the first connection configuration.

3. The method of claim 1, wherein determining the first pre-set discharge time period further is based on an estimated amount or type of waste to be discharged from the first source of waste.

4. The method of claim 1, wherein the first discharge sequence activator comprises a first controller for inputting the first pre-set discharge time period.

5. The method of claim 4, wherein the first controller of the first discharge sequence activator is operated manually or automatically.

6. The method of claim 1, wherein the vacuum waste system further comprises a first flush water valve connected between a first source of flush water and the first source of waste, wherein the first flush water valve further is operably coupled to the first discharge sequence activator, the method further comprising operating the first discharge sequence activator to actuate the first flush valve to execute a first flushing sequence, in which the first flush water valve is actuated from a closed position to an open position, the first flush water valves remains open for a first pre-set flush time period, and then the first flush valve is actuated from the open position to the closed position.

7. The method of claim 6, further comprising determining the first pre-set flush time period based on one or more of:

the first connection configuration between the first discharge valve and the first branch pipe, the first distance between the first discharge valve and the vacuum unit, a vertical height of the first connection configuration, a measured vacuum level at a point downstream of the first discharge valve, and an estimated amount or type of waste to be discharged from the first source of waste.

8. The method of claim 6, wherein the first discharge sequence activator comprises a second controller for inputting the first pre-set flush time to the first discharge sequence activator.

9. The method of claim 8, wherein the second controller of the first discharge sequence activator is operated manually or automatically.

10. The method of claim 6, wherein the first pre-set discharge time period and the first pre-set flush time are set independently of each other.

11. The method of claim 1, wherein the first discharge sequence activator comprises a control mechanism connected to the vacuum sewer piping and the first discharge valve.

12. The method of claim 1, wherein the first discharge sequence activator comprises an electrical control unit connected to the first discharge valve.

13. The method of claim 1, wherein the vacuum waste system further includes a first flush water valve, and wherein the first discharge sequence activator comprises a control mechanism connected to the vacuum sewer piping, the first discharge valve, and the first flush water valve.

14. The method of claim 1, wherein the vacuum waste system further includes a first flush water valve, and wherein the first discharge sequence comprises an electrical control unit connected to the first discharge valve and the first flush water valve.

15. The method of claim 1, wherein each of the first source of waste and the second source of waste comprises a vacuum toilet, a urinal, a wash basin, a shower, or a food waste station.

16. A vacuum waste system, comprising:

a first source of waste;

a second source of waste;

a vacuum unit configured to generate a vacuum;

vacuum sewer piping comprising a main pipe line coupled to the vacuum unit, and a first branch pipe coupled to the main pipe line, and a second branch pipe coupled to the main pipe line;

a first discharge valve coupling the first source of waste to the first branch pipe, wherein a first connection configuration of the first source of waste and the first branch pipe comprises either a downwards connection configuration or an upwards connection configuration;

a second discharge valve coupling the second source of waste to the second branch pipe, wherein a second connection configuration of the second source of waste and the second branch pipe comprises either a downwards connection configuration or an upwards connection configuration;

a first pressure sensor configured to measure a first vacuum level at a first point downstream of the first discharge valve;

a second pressure sensor configured to measure a second vacuum level at a second point downstream of the second discharge valve, wherein the second point is different than the first point;

a first discharge sequence activator operably coupled to the first discharge valve, the first discharge sequence activator being configured to:

receive a first pre-set discharge time period based, at least in part, according to the first connection configuration between the first discharge valve and the first branch pipe, and a first distance between the first discharge valve and the vacuum unit;

reduce the first pre-set discharge time period based on the first vacuum level to determine a first modified pre-set discharge time period; and actuate the first discharge valve to execute a first discharge valve sequence, in which the first discharge valve is actuated from a closed position to an open position, the first discharge valve remains open for the first modified pre-set discharge time period, and then the first discharge valve is actuated from the open position to the closed position; and a second discharge sequence activator operably coupled to the second discharge valve, the second discharge sequence activator being configured to:

receive a second pre-set discharge time period based, at least in part, according to the second connection configuration between the second discharge valve and the second branch pipe, and a second distance between the first discharge valve and the vacuum unit, wherein the second pre-set discharge time period is different than the first pre-set discharge time period;

reduce the second pre-set discharge time period based on the second vacuum level to determine a second modified pre-set discharge time period; and actuate the second discharge valve to execute a second discharge valve sequence, in which the second discharge valve is actuated from a closed position to an open position, the second discharge valve remains open for the second modified pre-set discharge time period, and then the second discharge valve is actuated from the open position to the closed position.

17. The vacuum waste system according to claim 16, wherein:

the vacuum waste system further comprises a first flush water valve connected between a first source of flush water and the first source of waste, wherein the first flush water valve further is operably coupled to the first discharge sequence activator; and the first discharge sequence activator further is configured to:

receive a first pre-set flush time period; and operate the first flush valve to execute a first flush valve sequence, in which the first flush valve is actuated from a closed position to an open position, the first flush valve remains open for a first pre-set flush time period, and then the first flush valve is actuated from the open position to the closed position;

wherein the first discharge sequence activator further comprises a second controller for inputting the first pre-set flush time period.

18. The vacuum waste system according to claim 17, wherein the first controller comprises a manual controller or an automatic controller.

19. The vacuum waste system according to claim 18, wherein the second controller comprises a manual controller or an automatic controller.

20. The vacuum waste system according to claim 16, wherein the first discharge sequence activator comprises an electrical control unit.

21. The vacuum waste system according to claim 16, further comprising an interface unit disposed between the first source of waste and the first discharge valve.

* * * * *